US005660636A

United States Patent [19]

Shangold et al.

[11] Patent Number: 5,660,636

[45] Date of Patent: Aug. 26, 1997

[54] APPARATUS FOR HOUSING AND DISPENSING HYGIENIC APPLICATORS

[76] Inventors: Gary A. Shangold, 1086 Buxton Rd.; Joel Lippman, 821 Carnoustie Dr., both of Bridgewater, N.J. 08807

[21] Appl. No.: 408,681

[22] Filed: Mar. 21, 1995

[51] Int. Cl.[6] ..... B05C 3/132

[52] U.S. Cl. ..... 118/500; 118/419; 118/423; 118/429; 242/564.4; 226/129

[58] Field of Search ..... 118/405, 419, 118/424, 423, 429, 500, 501, DIG. 17, 231; 242/382, 396.4, 564.4; 226/129

[56] References Cited

U.S. PATENT DOCUMENTS

| | | | |
|---|---|---|---|
| 3,771,742 | 11/1973 | Okada | 242/382 |
| 3,848,822 | 11/1974 | Boone | 242/590 |
| 4,057,220 | 11/1977 | Kudlacek | 242/396.4 X |
| 4,383,656 | 5/1983 | Campbell | 242/590 |
| 4,406,421 | 9/1983 | Schultz et al. | 242/564.4 |
| 4,620,502 | 11/1986 | Kimble | 118/419 |
| 4,732,306 | 3/1988 | Jesperson | 225/2 |
| 4,814,204 | 3/1989 | Carey et al. | 427/286 |
| 4,960,248 | 10/1990 | Bauer et al. | 242/564.4 |
| 4,984,530 | 1/1991 | Dutton | 118/43 |
| 4,991,538 | 2/1991 | Davids et al. | 118/231 |
| 5,242,495 | 9/1993 | Hammond et al. | 118/43 |
| 5,294,192 | 3/1994 | Omdoll et al. | 312/34.22 |
| 5,439,521 | 8/1995 | Rao | 118/415 |

*Primary Examiner*—Harold Pyon

*Attorney, Agent, or Firm*—Kane, Dalsimer, Sullivan, Kurucz, Levy, Eisele and Richard, LLP

[57] ABSTRACT

An apparatus for housing a plurality of applicators in a hygienic cavity and dispensing said plurality of applicators from said cavity. The apparatus includes a container for holding said plurality of applicators, a support structure for the plurality of applicators, a reservoir in fluid communication with the hygienic cavity, said reservoir being situated to facilitate wetting said plurality of applicators with said fluid during said dispensing; an aperture generally adjacent to said reservoir; said plurality of applicators traversing said aperture during said dispensing; and a dispenser structure actuable by a user from outside said container to engage at least one applicator of said plurality of applicators for causing advancement of said at least one applicator through said aperture to effect said dispensing.

16 Claims, 4 Drawing Sheets

APPARATUS FOR HOUSING AND DISPENSING HYGIENIC APPLICATORS

BACKGROUND OF THE INVENTION

The present invention is generally directed to an apparatus for housing and dispensing hygienic applicators so that the applicators are moist when dispensed. The present invention is more particularly directed toward an improved apparatus for moistening applicators and for minimizing contamination from the environment outside of the apparatus. The present invention is even more particularly directed toward an apparatus that is in a fixed location near a user.

Paper towelettes (also called tissues or cloths) are in widespread use for a variety of cleaning operations and for personal hygiene, for example, as toilet tissue. Some towelettes are made of materials other than paper, and may be premoistened and fashioned or packaged in portable containers. Some premoistened towelettes are individually folded and wrapped in plastic or in metal-foil type packets. Currently available premoistened towelettes have limitations that preclude their use as toilet tissue. These premoistened, individually packaged towelettes packets are generally heavy and are not dispensed from a continuous roll, as is toilet paper. This is wasteful and expensive because single sheet packaging requires a large amount of nonbiodegradable plastic or metal-foil wrapping materials.

Some premoistened towelettes are interleaved in a fashion characteristic of dry facial tissues and are packaged in containers having a foil sealing member to prevent moisture loss while the container is on the shelf. In use, the foil is removed and the towelettes are removed one at a time as use dictates. Interleaving is designed to permit ease of removal of the second towelette after the first is used. If there is no replacement lid for the foil seal, once opened, the towelettes tend to dry out rapidly. A conventional tissue box type of plastic dispenser having a single lid with a dispensing slot is only a slight improvement over the removable foil lid type of assembly because the towelette next to be dispensed is exposed to air through the slot and will dry. Wicking action causes the moisture in the towelettes within the box to migrate to the dry tip of the exposed towelette. The entire contents of the "tissue box" dry out relatively rapidly. Another problem is having lids that are tightfitting enough to prevent additional moisture loss at the juncture between the lid and the box walls. Proposed solutions to drying out of towelettes in a tissue box dispenser, include a flap covering the opening through which tissues are removed or an excess of fluid along with the towelettes.

A snap fitting lid with a small aperture through which leading edges of tissues are pulled, and a gasket sealing means with an open and closed position have been proposed to solve some of the problems with dispensers. U.S. Pat. No. 4,181,218.

Despite the disclosure of many types of dispensers, there is still a need in the art for a dispenser containing a plurality of individual applicators for transfer of fluids to human skin. There is still a further need in the art for a dispenser which is easy to use and economical to produce. There is a further need for a dispenser which keeps the applicators moist and hygienic until use. In contrast to portable systems, a dispenser in fixed proximity to a user of a toilet would be advantageous.

SUMMARY

The invention is an apparatus for housing and dispensing in a hygienic environment, applicators designed to transfer a fluid to human skin, said apparatus being configured so that the applicators are moist when dispensed.

A hygienic environment is a set of conditions that presents obstacles to entry of microorganisms and contaminants into the environment; in the present invention, obstacles include total enclosure of a roll of applicators in a housing, with a single aperture to the outside environment, said aperture only wide enough to permit passage of a single applicator, wherein passage of a applicator is achieved by contact by a user only to the single applicator being passed to the outside. The hygienic environment is enhanced by a reservoir of fluid adjacent to the aperture, said reservoir containing fluid used to premoisten the applicators said fluid comprising a fluid that is not conducive to microbial growth.

The invention relates to an apparatus for housing a plurality of applicators in a hygienic cavity. The applicators may be dry or moistened when they are placed into the apparatus. Moistened includes dry applicators that are moistened by contact with a fluid, as well as further moistened by adding fluid to premoistened applicators, that is, applicators that are contacted with fluid prior to being encased in a housing.

The apparatus for containing and dispensing a plurality of applicators includes a housing having an inner surface and an outer surface. The inner surface encloses a hygienic cavity which is configured to contain said plurality of applicators. A support piece within said housing has a first end and a second end, said first end and second end being coupled with said inner surface, and said support piece supportingly engaging said plurality of applicators within said cavity. A reservoir within said hygienic cavity is integrally formed by said inner surface and contains a fluid. An aperture in said housing is configured to pass said plurality of applicators from said hygienic cavity, via said reservoir, to outside said housing. Said passing is effected by said plurality of applicators. The aperture is configured to preclude passage of a human finger into said aperture. The aperture is oriented approximately to minimize entry of contaminants to said cavity.

The applicators may be wound in a roll or folded in any manner that permits applicators to be retrieved from the apparatus one at a time. The apparatus facilitates dispensing said plurality of applicators from said cavity. The container is configured for attachment to a stationary surface. The apparatus comprises the following elements:

(a) a container for holding said plurality of applicators, said container having an inner surface defining said cavity;

(b) a support structure configured to cooperate with said inner surface to support said plurality of applicators within said cavity;

(c) a reservoir in fluid communication with said cavity; said reservoir containing a fluid; said support structure, said inner surface, and said reservoir being situated to facilitate wetting said plurality of applicators with said fluid during said dispensing;

(d) an aperture in said inner surface generally adjoining said reservoir; said plurality of applicators traversing said aperture during said dispensing; and (e) a dispenser structure coupled with said container; said dispenser structure being actuable by a user from outside said container to engage at least one applicator of said plurality of applicators for causing advancement of said at least one applicator through said aperture to effect said dispensing.

In an illustrative embodiment the support structure is a roller supporting a roll of said plurality of applicators. If the support structure is a roller, said plurality of applicators is wound around a solid or hollow core that controls dispensing of the applicators. The plurality of applicators has a leading tab on a first applicator to be dispensed of said plurality of applicators.

A particular applicator of said plurality of applicators traverses the reservoir by passing under a retaining bar positioned at the end of the reservoir in closest proximity to the aperture and through the reservoir to the aperture.

A ratchet means controls dispensing of said plurality of applicators; a single ratchet advances a single applicator for dispensing. A separating means may consist of a built in, sharp serrated edge located at the distal end of the outlet feeder.

The present invention includes a container/dispenser for premoistened applicators which is used for perineal hygiene and is accessible to a person seated on the toilet. The invention replaces dry toilet paper, and is a conveniently-accessible resource which affords superior cleansing ability.

The system includes an apparatus for containing and dispensing the applicators, and a method for premoistening and dispensing the applicators in a hygienic fashion, that is, while maintaining each applicator in a hygienic environment until its removal for immediate use. This is accomplished by a protective housing which dispenses only one applicator at a time, and prevents handling of successive applicators until each is in turn dispensed. The dispenser is attached to a fixed surface in proximity to a user, where proximity is defined as within easy reach of a user seated on a toilet.

The system includes a container, or housing which can be readily and easily attached to, and removed from, the wall of a bathroom or stall either by attachment of a roller to the preexisting depression or bracket intended for conventional dry toilet paper roller lining, or by adhesion to a fixed surface such as a wall.

The applicator dispenser is a cylindrical, concentric or helical housing containing a downward protrusion which performs as a feeder outlet for dispensing the leading edge of individual applicator. Materials suitable to construct the housing includes hard, premolded plastic, or of a softer plastic, and includes a closed container which maintains unused applicators in a state of maximum cleanliness by isolation from the outside environment. Although a plastic material is preferred because it is inexpensive and easy to mold, any material which is sturdy and moisture and vapor proof is suitable for the housing.

Running through the center of the cylindrical housing generally parallel to the floor is a roller device which attaches to the central axis of the container, and which has retractable protrusions which fit into receiving depressions in existing built-in or wall-mounted attachments which are currently used for conventional toilet paper.

The roller device permits the unrolling of the roll of applicators contained within, while the housing remains relatively fixed in place. The applicators form a continuous roll, which is perforated to allow the tearing away of individual applicators. Applicators are coiled or wound around this central roller, and are unwound in a direction such that the top of the roll moves toward the wall and the bottom of the roll moves away from the wall. While passing through the most dependent (lowermost) aspect, the applicators pass under a retaining bar in the housing, which forces them to move through a small reservoir of extra moistening fluid, before turning upward to clear a final ridge in the housing. This ensures that the applicator about to be used will be sufficiently moistened at the time of use, and will not dry out, as often occurs in other containers currently available.

The applicator roll is placed in the dispenser with a leading edge of the top applicator exposed. As a result of this presentation, a user pulls on the exposed edge of the applicator to remove it through an aperture. To dispense a applicator, the roll of applicators turns downward for its final descent through the outlet feeder. In this portion of the housing, there is a separating means and a dispensing means. The roll passes through a mechanism which permits an operator (user) to control the advance of the leading edge of the roll.

In one embodiment, the dispensing means is a pair of opposing flanges that are squeezed together by the operator's (user's) thumb and forefinger, thereby engaging two surfaces which surround the advancing applicator on its front and back surfaces. These flanges are then manually moved downward to pull the edge of the applicator through an aperture in the container, from where it can be grasped by the user and acted on by a separating means, e.g., separated by a user tug from the perforated attachment of the dispenser to the next applicator which is still within the container. The flanges are then released, causing them to both separate one from the other and to return by a spring-loaded mechanism to their starting position. By releasing the flanges, a separate pair of bars are caused to be engaged, squeezing the next applicator on its front and rear aspects, in order to hold it stationary while the operator tears off the preceding applicator.

In another embodiment the dispenser structure engages an applicator in an embodiment by means of a pair of rollers between which the applicator passes. The rollers are situated to rotate around their respective axes in directions opposite to each other to facilitate advancing the applicator toward the aperture and separating the applicator that has traversed the aperture from an applicator attached to the traversing applicator. The aperture is structured and positioned so that fingers cannot enter the aperture and contaminants from outside the hygienic cavity are minimized.

The pair of rollers surrounds the advancing applicators on the front and rear aspects. These rollers are operated by two interdigitating cogwheels, which are operated by a rotating knob, or by a lever-operated crank handle and the like, on the outside of the container, which when turned by the operator, causes the rollers to turn in opposite directions, thereby advancing the leading edge of the applicator until it can be grasped manually and separated from its attachment to the next applicator as above.

In both cases, either the spring-loaded retaining bar from the flange mechanism or the rollers themselves would grasp the next advancing applicator sufficiently strongly as to permit the operator to tear away the first applicator, which protrudes beyond the sealed plastic outlet of the container.

In an embodiment including a replaceable plurality of applicators the apparatus further comprises a container of hygienic fluid, said container being in fluid communication with said reservoir. In an embodiment of this structure the container has a removable panel through which a refill roll with a plurality of applicators is introduced into the cavity of the container, said panel, configured to facilitate refilling said cavity with a new plurality of applicators which may be dry at said refilling.

A wall of the container may be removable so that a replacement roll of applicators may be inserted after a first roll is dispensed. The wall may be lateral, at the top, or at the front of the housing. The replacement roll is encased in a fluid-impervious and vapor-impervious container, which is removed upon insertion of the roll into the container. The movable wall of the container is then reattached.

In still another embodiment, the container provides a mechanism for the insertion and release of a removable cartridge, which cartridge is a replaceable container for a specified quantity of hygienic, premoistened applicators. The cartridge may include an internal support structure such as a solid or hollow roller. The cartridge is hygienically sealed until it is opened and loaded into the dispenser, at which time the first applicator is pulled out, e.g. by means of a leading tab, beyond two retractable soft plastic lips. Upon completion of removal of an individual applicator, the cartridge tends to continue to protect the hygienic condition of the remaining applicators in the cartridge. Refill cartridges are easy to replace by simply snapping in a new cartridge. A new plurality of applicators is thus loaded either from a package with a removable overwrap, or from a self-contained cartridge which can be placed intact into a dispenser.

In summary, the system includes the following features: (1) an applicator dispenser is affixed to the wall of a bathroom or stall; to avoid complicated installation procedures which might be a disincentive to adoption of the system, no drilling of holes, screwing or nailing, is required, for example, an adhesive backing is suitable; (2) the dispenser can remain in place for long periods of time, and therefore may be designed to accept and retain removable cartridges or cassettes which would snap into place for replacement, and which contain a standard, defined quantity of applicators for ease of use and manufacture; (3) the cartridge holding the applicators maintains an essentially closed system which provides for prolonged hygienic protection of the applicators from the possibility of contamination by previous users, and provides a relatively simple mechanism for the extrusion, release, and detachment of applicators as needed at the time of dispensing. The latter requirement is satisfied by the employment of a set of moving levers, grasping rods, or rollers, which are contained within each cartridge and protrude from the sides of the cartridges and present themselves to a receptor contained within the holder which is affixed to the wall, thereby providing access via a controlling device (rod or lever) which is operated by the user on demand. This device effects the extrusion and release of a single wet applicator, and subsequently returns to its original position in order to prepare for the extrusion and release of subsequent applicators.

By virtue of its attachment to existing toilet paper roll holders in bathroom stalls, the dispenser guarantees availability of premoistened applicators when and where they are needed, without the transportation of a cumbersome boxlike dispenser into the stall for each anticipated use, while simultaneously facilitating the adaptation of this system of moist applicators in lieu of toilet paper, without retrofitting or defacing existing hardware or wall coverings.

Modifications within the scope of the invention include differences in size of the applicators, the nature of the moistening solution, the strength of the applicators, and degree of their flushability and biodegradability, so as to avoid clogging toilet bowls or plumbing systems after flushing. Second, the packaging of these applicators may be modified depending on site of use. The container is neat and attractive, and may be enhanced by various surface designs and colors.

If the container is attached to an existent toilet paper dispenser of the type which is mounted onto and protruding from the wall (as opposed to being built into a wall), it would hang out and spin or jiggle as an applicator is removed. To prevent that undesirable action which would disrupt the position of the reservoir, risking spilling its contents into the non-reservoir portion of the hygienic cavity which would cause uneven and/or excessive wetting of applicators, stability is provided by a guard means, for example, a set of retractable bars, which when positioned outward from the dispenser, roughly engage both the upper and lower borders of the existing brackets which hold the toilet paper rollers, (or applicator) thereby preventing rotation of the dispenser in order to keep the dispenser in a fixed position. Additionally, a downward-protruding hook on the plastic container accepts an optional hanging folder attachment, which would permit a user to store preferred bathroom reading material (newspapers, magazines, and the like).

It is therefore an advantage of the present invention to provide an apparatus to dispense hygienic applicators in locations within easy reach of a user in, e.g. bathroom stalls. It is a further advantage of the present invention to provide a reservoir for moistening an applicator immediately prior to its being dispensed.

It is a still further advantage of the present invention that the apparatus may be economically manufactured and assembled.

Further objects and features of the present invention will be apparent from the following specifications and claims when considered in connection with the accompanying drawings illustrating the preferred embodiment of the invention.

DESCRIPTION OF THE PREFERRED EMBODIMENT

Figure 1A:
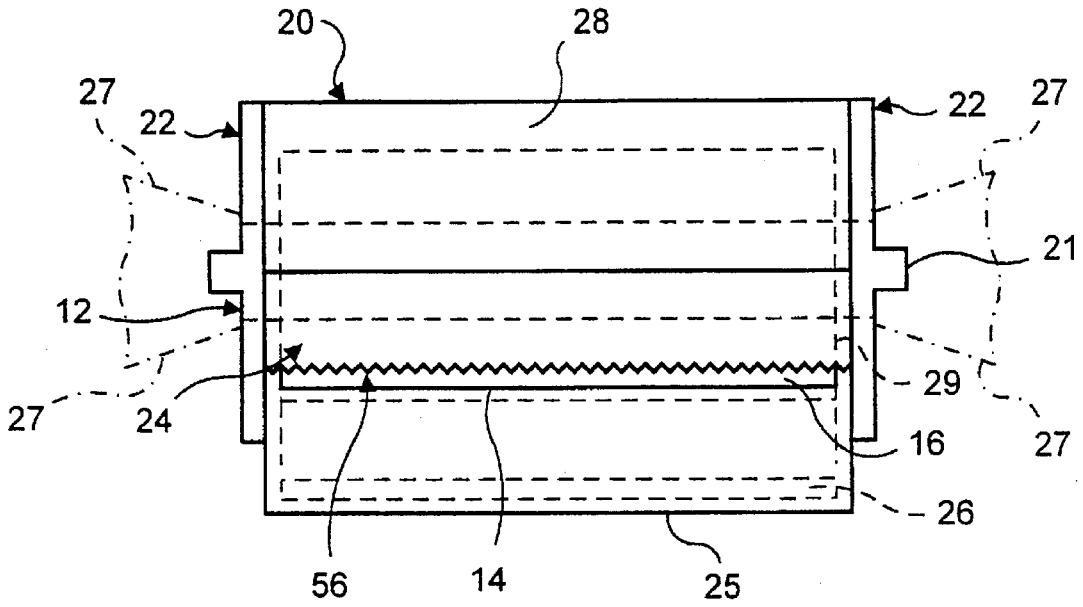
FIG. 1A is a front elevation view of a first embodiment of an apparatus for housing and dispensing hygienic applicators.

An apparatus for housing and dispensing hygienic applicators which transfer a fluid to human skin is described.

In the drawings, wherein like reference numerals indicate like parts throughout several views, an apparatus for housing and dispensing hygienic applicators so that the applicators are moist when dispensed, is shown.

FIGS. 1A, B and C show a first illustrative embodiment in which the apparatus consists of a cylindrical container 20 for a roll of pre-moistened applicators 29. FIG. 1A is a front view of an apparatus for housing and dispensing hygienic applicators. The roll 29 includes a support structure 21 which serves as an axle through a central core 12 of the roll 29. Central core 12 is attached to an innermost first applicator on the roll 29. Roll 29 turns when the leading border 14 of an outermost applicator 16 of a connected collection of applicators 18 leading from roll 29 is pulled upon by a user. Container 20 remains stationary as roll 29 turns.

A retaining bar 26 is located in spaced relation from container 20 within the reservoir 25. The retaining bar 26 traverses the entire width of the hygienic cavity 28, and forces the connected applicators 18 (FIG. 1C) to traverse a path 38 between the bar 26 and container 20, positioning the connected applicators 18 within the reservoir 25. A collar 22 is attached to each end of the central core 12 and surrounds both sides of the container 20. The collars 22 rotate with the supporting structure 21, while the container 20 remains stationary. Collar 22 provides a means for directly manually turning the support structure 21 and hence advancing the connected applicators 18, in case the leading edge 14 of an applicator might withdraw into the container 20, beyond the reach of a user's fingers from outside of the container 20.

The container 20 alternatively may have a hollow core (not shown) which fits over an existing roller device in an existing toilet paper dispenser. In this embodiment, the roll 29 is attached to the central core 12 at the last applicator, that is, the innermost applicator on the roll 29, but roll 29 is not directly attached to the container 20. Thus, roll 29 may rotate to advance the collection of applicators 18 while the container remains stationary. In either embodiment described above, the connection between the central core 12 (with or without an attached roller axle) and the container 20 may include a ratcheting mechanism (not shown) to insure that a single ratchet or specified number of ratchets of the ratchet mechanism advances roll 29 for a distance approximately the length of one applicator of the collection of applicators 18, thereby always presenting a next applicator of the collection of applicators for dispensing.

Collar 22 forms the sides of the container 20 and is joined to the support structure 21 so that the collar 22 and the support structure 21 rotate jointly as leading applicators of the collection of applicators 18 to roll 29 advances through the reservoir 25, under the retaining bar 26, and through the outlet feeder 24, and separating mechanism 56.

Opposed pairs of retractable bars 27 extend obliquely from container 20. Retractable bars 27 are designed to engage both the upper and lower borders of existing brackets which hold toilet paper rollers, thereby preventing rotation of the dispenser in order to keep the dispenser in a fixed position.

Figure 1B:
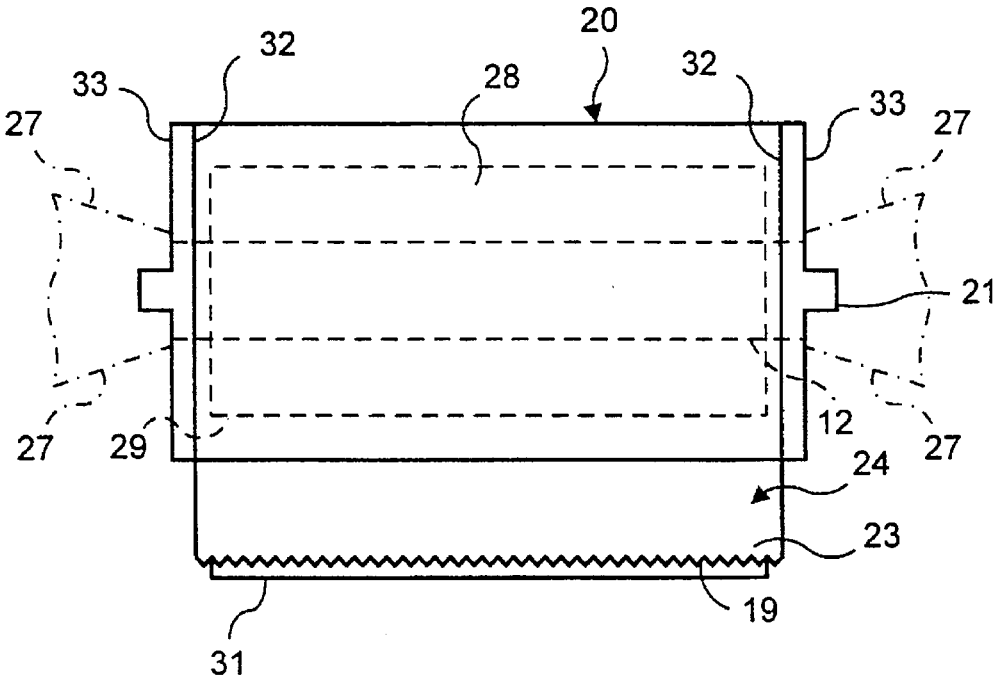
FIG. 1B is a top view of the first embodiment of the apparatus for FIG. 1A for housing and dispensing hygienic applicators.

FIG. 1B is a top elevation view of a first embodiment of the apparatus of FIG. 1A for housing and dispensing hygienic applicators. Container 20 has an inner wall 32 and outer wall 33. The inner wall 32 encloses a hygienic cavity 28. An aperture 23 in the container 20 allows an applicator of the collection of applicator 16 of roll 29 to exit the hygienic cavity 28. The aperture 23 is configured large enough to permit an applicator to easily exit without disrupting its structural integrity, yet small enough to preclude entry by a human finger.

Optionally there is a serrated edge 19 which assists in separating a single applicator from the collection of applicators 18 of roll 29 after the single applicator is dispensed. Edge 19 of applicator 18 in FIG. 1B is also illustrated with a leading tab 31 which is optionally placed on a first applicator to be dispensed of a plurality of applicators.

Figure 1C:
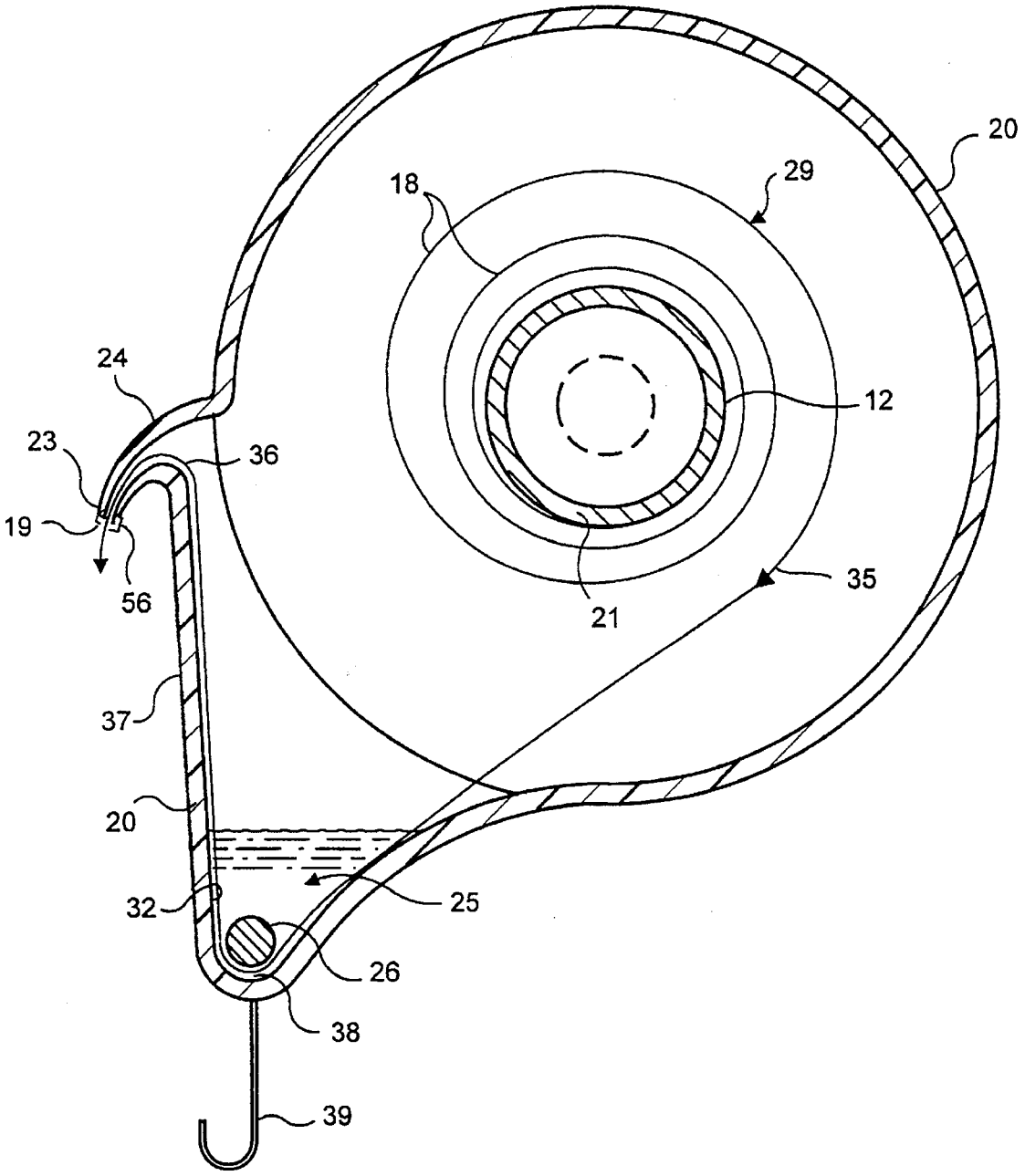
FIG. 1C is a side view of the apparatus of FIG. 1A for housing and dispensing hygienic applicators.

FIG. 1C is a side view of the apparatus of FIG. 1A for housing and dispensing a plurality of applicators. The path the collection of applicators 18 travels is shown by the arrow 35. As an applicator proceeds towards the outlet feeder 24, the applicator passes under the retaining bar 26 in the reservoir 25 so that each applicator is submerged in the fluid in the reservoir 25 as the applicator passes between the retaining bar 26 and container 20.

After passing between the retaining bar 26 and container 20 an applicator passes through an outlet feeder 24 which is preferably about the same length as a length of an individual applicator of the collection of applicators 18. After an applicator is dispensed through the outlet feeder 24, the next applicator of the collection of applicators 18 to be dispensed protrudes only far enough from neck 37 to the outlet feeder 24 that it can be grasped by a user. The remainder of the next applicator to be dispensed remains in the outlet feeder 24 where it is kept moist by a wicking action of fluid from the reservoir 25. The small dimensions of neck 37 and the outlet feeder 24 minimize both evaporation of wicked fluid and entry of contaminants from outside the apparatus. Also aiding in preventing moisture loss and contamination entry is the downward direction of the path of the collection of applicators 18 through the outlet feeder 24.

The front aspect of the container has a protruding reservoir 25 through which the collection of applicators 18 is forced to travel by passing between retaining bar 26 and container 20. Retaining bar 26 extends from one inner wall 32 to the other inner wall 32 of container 20. An excess of moistening fluid resides in reservoir 25. The collection of applicators 18 then passes upward to a level above the fluid in the reservoir 25 and through the neck 37 before making a turn over a ridge 36 to the outlet feeder 24. A simple separating mechanism 56 is located on the lower border of the aperture 23. Embodiments of this mechanism 56 include a serrated edge 19, which facilitates tearing off a single applicator at a perforated edge.

At substantially the lowermost portion of container 20, where reservoir 25 is formed, downwardly protruding hook 39 attached to accept an optional hanging folder attachment to hold reading material.

Figure 2C:
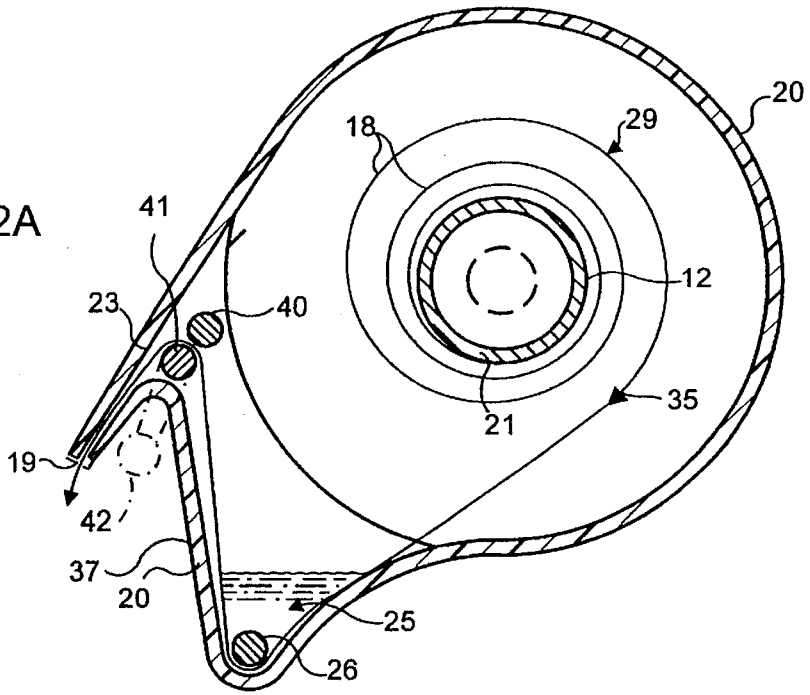
FIG. 2C is a side view of the apparatus of FIG. 2A and 2B for housing and dispensing hygienic applicators.
Figure 2A:
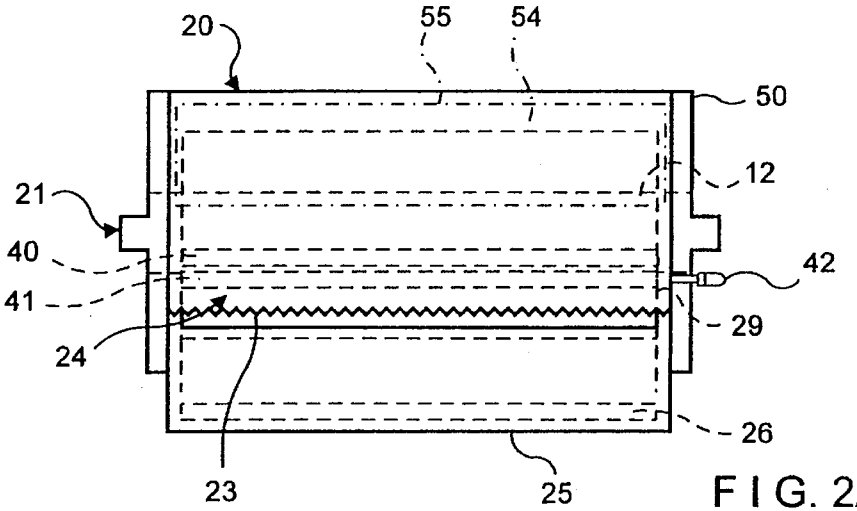
FIG. 2A is a front elevation view of a second embodiment of an apparatus for housing and dispensing hygienic applicators.
Figure 2B:
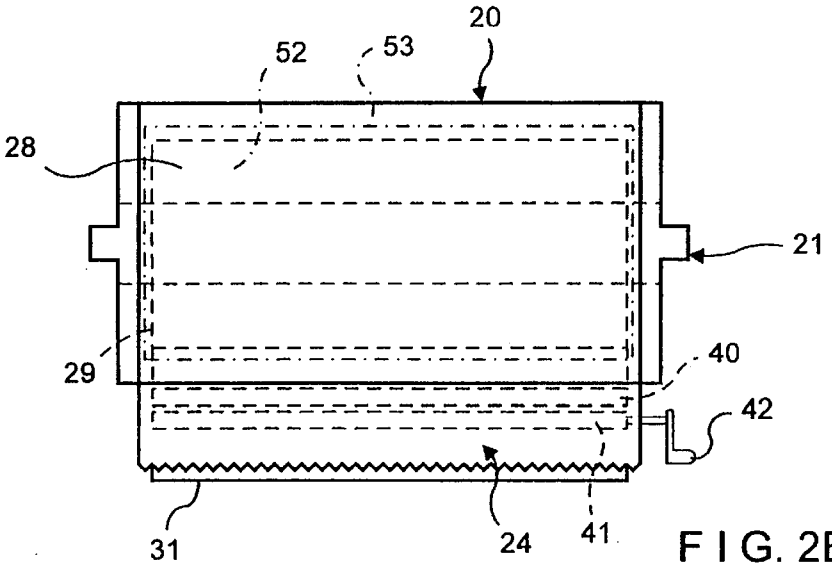
FIG. 2B a top view of the apparatus of FIG. 2A for housing and dispensing hygienic applicators.
Figure 3B:
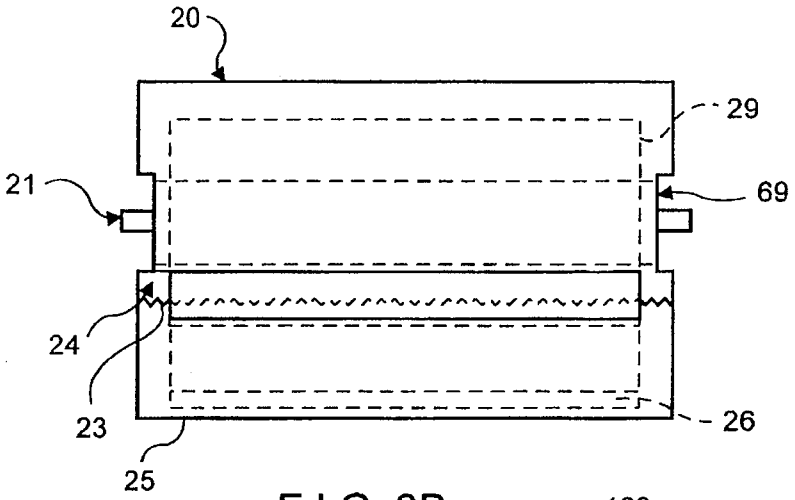
FIG. 3B is a front view of a mounting bracket for an embodiment of an apparatus for housing and dispensing hygienic applicators.
Figure 3D:
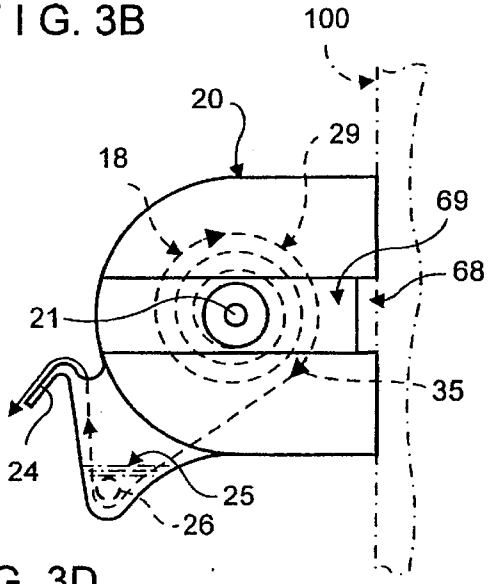
FIG. 3D is a cross-sectional side view of an apparatus for housing and dispensing hygienic applicators.
Figure 3A:
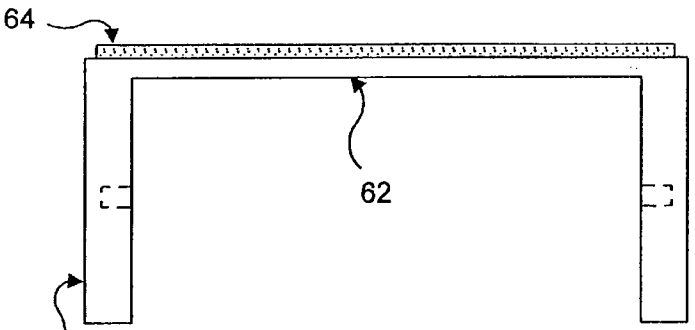
FIG. 3A is a top view of mounting bracket for an embodiment of an apparatus for housing and dispensing hygienic applicators.
Figure 3C:
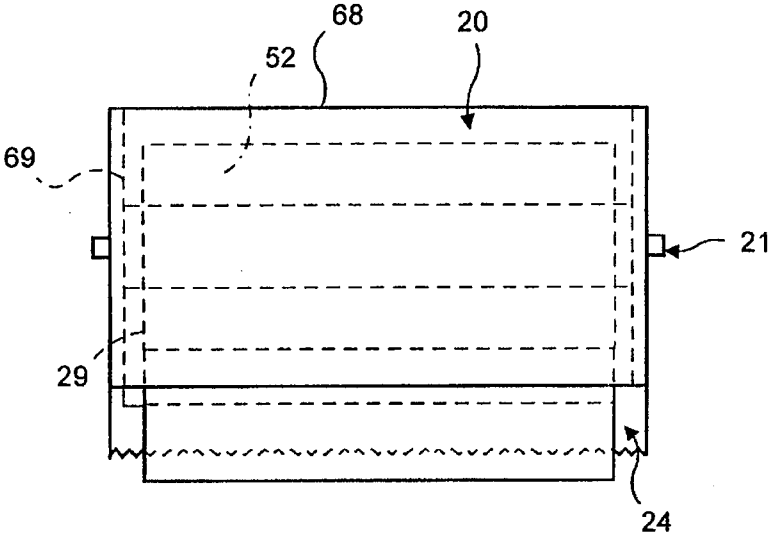
FIG. 3C is a top view of an embodiment of an apparatus for housing and dispensing hygienic applicators.

In FIGS. 2A–C, the container 20 additionally contains a set of rollers 40, 41 at the outlet feeder 24 just superior to the reservoir 25 and between the reservoir 25 and an aperture 23. The rollers 40, 41 surround an advancing applicator of the collection of applicators on the inner and outer surfaces of the applicator, and guide the applicators to aperture 23 for dispensing. The rollers 40, 41 are preferably operated by either a thumbscrew or crank handle 42, which engages two interdigitating cogwheels (not shown). The cogwheels in turn cause the rollers 40, 41 to turn in opposite directions, thereby causing the applicator roll 29 to advance. This advancing mechanism, either by a ratcheting mechanism or by the force of an applicator traversing its normal excursion length, helps push forward the length of a single applicator toward the outlet feeder 24 with each advance. In addition, the rollers may be part of a separating mechanism. Because of their firm apposition to each other, the rollers 40, 41 hold the next advancing applicator stationary while the lead applicator which has been moved through the outlet feeder 24 is torn away by a user. Preferably, the outlet feeder 24 is lengthened somewhat in this embodiment in comparison to the length of the outlet feeder 24 in the first embodiment so that the leading edge of the next applicator to be dispensed is not able to be reached by a user until the advancing mechanism (handle 42 and rollers 40, 41) is operated to dispense the next applicator. This second configuration provides for improved maintenance of a hygienic environment when compared to the first embodiment. The length of the outlet feeder 24 is determined by that length which will allow an applicator in the outlet feeder 24 to stay moist after passing through the reservoir 25 while waiting in the outlet feeder 24 to be dispensed. The rollers 40, 41 provide further barriers to moisture loss and contamination.

In a third embodiment, the container 20 and associated dispensing and separating mechanisms described in the second embodiment are re-usable and the roll 29 is replaced when all of the collection of applicators 18 of a previous roll are dispensed. For this embodiment, the container 20 opens in order to admit replacement applicator rolls 29. Opening is accomplished by means of removing either a side 50, top 52, or front panel 54 of the container 20.

In FIG. 2A, a detachable front panel 54 is shown; its boundaries are illustrated by borders 55. Exemplary detachable side panels are indicated by 50. In FIG. 2B, an exemplary detachable top panel 52 is shown; its boundaries are illustrated by borders 53. The dimensions of any such detachable panel are determined by the size of the applicator roll 29 to be inserted through the space exposed when the panel is removed.

Refilling the container may be accomplished by one of the following means: (a) inserting a simple pre-packaged roll of pre-moistened applicators; or (b) inserting a pre-packaged roll of dry applicators, each of (a) or (b) along with a container of a sufficient quantity of hygienic moistening fluid to provide for the manual refilling of the reservoir when needed; or (c) inserting a self-contained pre-packaged cartridge containing both pre-moistened applicators and an attached reservoir, which is inserted as a unit into position through the opening 50 (or 52 or 54) in the container.

In the first two instances (a and b), a leading tab, for example of plastic which is stiffer than the applicators, is pulled upon by the user after the new roll 29 of applicators are installed on the central core 12, in order to advance the collection of applicators 18 and thread them under the retaining bar 26 in the reservoir 25 and through the rollers 40, 41 leading to the outlet feeder 24. This tab is removed after such threading, leaving the first applicator of the collection of applicators 18 of roll 29 in position for dispensing.

As shown in FIGS. 3A–D, in another alternate embodiment, the invention includes a pair of brackets 60 having a distance between the brackets approximately equal to the width of the applicator container 20 (FIG. 1B, 2B and/or 3B). Brackets 60 are joined by a horizontal mounting piece 62, which is fastened to a wall 100 either by means of a strong adhesive backing 64 or by conventional screws or nails (not shown). The adhesive backing 64 has the advantage of not defacing existing hardware, but screws or nails provide a more secure attachment. The brackets 60 receive a mountable apparatus and either a single or a multiple use cartridge which includes the applicator container 20. Thus, by means of the bracketing apparatus, any of the embodiments described previously may be applied to a wall 100 without requiring the use of any existing toilet paper roll receptacle. This embodiment may be preferred by users who wish to have access to both dry toilet paper and the moist applicators of the present invention. If the brackets are fastened to a wall by means of an adhesive backing, then the shape of the cartridge which embodies the container/dispenser, has a rectangular back and sides, and a groove running the length of the back 68 and each side 69, so that the container 20 is fastened to the brackets 60 by sliding over them and articulating intimately to the sides 69 and back 68 of the brackets 60 bringing the entire rear aspect of the container 20 close to the wall. This construction provides for a more stable attachment to a wall 100 than would, for example, a cylinder which would hang freely from the free ends of the brackets 60, because a container 20 closely situated with a wall 100 is less likely to force the brackets to detach from the wall 100 while an applicator is being dispensed from the container.

Optionally an accessory hook may be attached to the outer surface of said dispenser 20. The hook can be used to hold items such as magazines and toiletries. A bag or envelope may be suspended from the hook to hold accessories.

An applicator is preferably rectangular or square and has four borders, a first border positioned toward the direction of movement of the collection of applicators 18 toward an aperture 23 in the container 20 through which an applicator is dispensed, a second border positioned opposite the direction of such movement, and two lateral borders. The first and second borders may be perforated. Each respective applicator is preferably attached to an applicator on either side of it in the collection of applicators 18 at its respective first and second borders, except for the first and last applicator on a roll 29, which first and last applicators are each only attached to one other applicator.

A suitable fluid impregnating the applicators is any fluid that provides a cleansing, lubricating or medicament action, or any combination thereof, which is safe for use on human skin. An example is the aqueous lotion of U.S. Pat. No. 4,904,524. An applicator also has an inner and an outer surface relative to the center of the collection of applicators 18 or roll 29. Suitable material for construction of the aperture includes hard or soft plastic, polyurethane, rubber and the like.

What is claimed is:

1. An apparatus for housing a plurality of applicators in a hygienic cavity; the apparatus facilitating dispensing said plurality of applicators from said cavity, the apparatus comprising:

(a) a container for holding said plurality of applicators, said container having an inner surface defining said cavity;

(b) a support structure configured to cooperate with said inner surface to support said plurality of applicators within said cavity;

(c) means for mounting said container to horizontally opposed coaxial apertures on a pair of brackets;

(d) a reservoir in fluid communication with said cavity; said reservoir containing a fluid; said plurality of applicators being supportingly engaged by said support structure in a position within said cavity apart from said reservoir of said fluid, said plurality of applicators subsequently passing through said reservoir and hence passing through said fluid to facilitate wetting said plurality of applicators with said fluid during said dispensing;

(e) an aperture in said inner surface generally adjacent to said reservoir; said plurality of applicators traversing said aperture during said dispensing;

(f) a dispenser structure coupled with said container; said dispenser structure being actuable by a user from outside said container to engage at least one applicator of said plurality of applicators for causing advancement of said at least one applicator through said aperture to effect said dispensing;

(g) wherein said reservoir is formed from a protruding portion of said container, said protruding portion acting as a stop to inhibit rotation of said container when at least one applicator is dispensed through said dispensing structure;

(h) wherein said fluid in said reservoir is separate from said plurality of applicators when supported by said support piece, said plurality of applicator being individually exposed to said fluid in said reservoir immediately prior to dispensing; and (i) wherein said support structure includes a ratchet means; said ratchet means having a plurality of ratchet teeth and a pawl; said ratchet means controlling said dispensing by said pawl engaging a single or multiple ratchet tooth of said plurality of ratchet teeth as a single applicator of said plurality of applicators is dispensed.

2. An apparatus for housing a plurality of applicators in a hygienic cavity as recited in claim 1, wherein said plurality of applicators is wound around a hollow core, said hollow core surrounding said support structure, said support structure being a roller disposed within said hollow core.

3. An apparatus for housing a plurality of applicators in a hygienic cavity as recited in claim 1, wherein said dispenser structure engages a respective said applicator by a pair of opposed rollers; said respective applicator passing intermediate said opposed rollers.

4. An apparatus for housing a plurality of applicators in a hygienic cavity as recited in claim 1, wherein said aperture is configured to resist entry within said container by fingers of a user.

5. An apparatus for housing a plurality of applicators in a hygienic cavity as recited in claim 1, wherein said plurality of applicators has a leading tab on a first applicator to be dispensed of said plurality of applicator.

6. An apparatus for housing a plurality of applicators in a hygienic cavity as recited in claim 1, wherein said container is configured for attachment to a stationary surface.

7. An apparatus for housing a plurality of applicators in a hygienic cavity as recited in claim 1, wherein said support structure is a roller; said roller supporting a roll of said plurality of applicators.

8. An apparatus for housing a plurality of applicators in a hygienic cavity as recited in claim 7, wherein said container further includes a retaining bar fixedly situated within said cavity, each respective applicator of said plurality of applicators traversing said reservoir by passing between said retaining bar and said inner surface prior to said wetting.

9. An apparatus for housing a plurality of applicators in a hygienic cavity as recited in claim 1, wherein said container further includes a removable panel configured to facilitate refilling said cavity with a new said plurality of applicators which can either be loaded from an overwrap package or which may itself consist of a self-contained cartridge which can be placed into the dispenser intact.

10. An apparatus for housing a plurality of applicators in a hygienic cavity as recited an claim 9, wherein said new plurality of applicators is dry at said refilling.

11. An apparatus for housing a plurality of applicators in a hygienic cavity as recited in claim 10, wherein the apparatus further comprises or can be refilled with a container of hygienic fluid, said container being in fluid communication with said reservoir.

12. An apparatus for containing and dispensing a plurality of applicators, said apparatus comprising:

(a) housing having an inner surface and an outer surface; said inner surface enclosing a hygienic cavity; said cavity being configured to contain said plurality of applicators;

(b) a support piece within said housing, said support piece having a first end and a second end, said first end and said second end being coupled with said inner surface support piece being supportingly engaging said plurality of;

(c) a reservoir within said hygienic cavity; said reservoir being integrally formed by said inner surface and containing a fluid, said plurality of applicators being supportingly engaged by said support piece in a position within said cavity apart from said reservoir of said fluid, said plurality of applicators subsequently passing through said reservoir and hence passing through said fluid during dispensing of said plurality of applicators;

(d) an aperture in said housing; said aperture being configured to pass said plurality of applicators from said hygienic cavity, via said reservoir, to outside said housing; said passing being serially effected by said plurality of applicators; said aperture being configured to preclude passage of a human finger into said aperture; said aperture being oriented appropriately to minimize entry of contaminants to said cavity;

(e) means for connecting said housing to a fixed surface, said means for connecting including horizontally opposed coaxially aligned cylindrical protrusions on sides of said outer surface of said housing, said protrusions engaging horizontally opposed coaxially aligned apertures on a bracket, said bracket including means for fastening to said fixed surface;

(f) wherein said fluid in said reservoir is separate from said plurality of applicators when supported by said support piece, said plurality of applicator being individually exposed to said fluid in said reservoir immediately prior to dispensing; and (g) wherein said support structure includes a ratchet means; said ratchet means having a plurality of ratchet teeth and a pawl; said ratchet means controlling said dispensing by said pawl engaging a single or multiple ratchet tooth of said plurality of ratchet teeth as a single applicator of said plurality of applicators is dispensed.

13. The apparatus for housing a plurality of applicators in a hygienic cavity of claim 12, wherein the fixed surface is a wall.

14. The apparatus for housing a plurality of applicators in a hygienic cavity of claim 12, further defined as having an accessory hook.

15. The apparatus for housing a plurality of applicators in a hygienic cavity of claimable 12, wherein said housing includes a flat rear surface, said flat rear surface engaging said fixed surface thereby acting as a stop to inhibit rotation of said housing when at least one applicator is dispensed through said aperture.

16. An apparatus for containing and dispensing a plurality of applicators, said apparatus comprising:

(a) housing having an inner surface and an outer surface; said inner surface enclosing a hygienic cavity; said cavity being configured to contain said plurality of applicators;

(b) a support piece within said housing, said support piece having a first end and a second end, said first end and said second end being coupled with said inner surface, and said support piece supportingly engaging said plurality of applicators within said cavity;

(c) a reservoir within said hygienic cavity; said reservoir being integrally formed by said inner surface and containing a fluid;

(d) an aperture in said housing; said aperture being configured to pass said plurality of applicators from said hygienic cavity, via said reservoir, to outside said housing; said passing being serially effected by said plurality of applicators; said aperture being configured to preclude passage of a human finger into said aperture; said aperture being oriented appropriately to minimize entry of contaminants to said cavity;

(e) means for connecting said housing to a fixed surface, said means for connecting including horizontally opposed coaxially aligned cylindrical protrusions on sides of said outer surface of said housing, said protrusions engaging horizontally opposed coaxially aligned apertures on a bracket, said bracket including means for fastening to said fixed surface;

(f) further including two pairs of spreading symmetrical rods positioned to engage to the bracket to maintain the apparatus in a fixed position;

(g) wherein said fluid in said reservoir is separate from said plurality of applicators when supported by said support piece, said plurality of applicator being individually exposed to said fluid in said reservoir immediately prior to dispensing; and (h) wherein said support structure includes a ratchet means; said ratchet means having a plurality of ratchet teeth and a pawl; said ratchet means controlling said dispensing by said pawl engaging a single or multiple ratchet tooth of said plurality of ratchet teeth as a single applicator of said plurality of applicators is dispensed.

* * * * *